US007055298B2

(12) United States Patent
Rossi et al.

(10) Patent No.: US 7,055,298 B2
(45) Date of Patent: Jun. 6, 2006

(54) DEVICE FOR PACKAGING PRODUCTS UNDER CONTROLLED ATMOSPHERE

(76) Inventors: Jean-Pierre Rossi, 6, Rue du Chateau, BP 50, Livry-Gargan (FR) F-93190; Marie-Jose Rossi, 6, Rue du Chateau, BP 50, Livry-Gargan (FR) F-93190

( * ) Notice: Subject to any disclaimer, the term of this patent is extended or adjusted under 35 U.S.C. 154(b) by 0 days.

(21) Appl. No.: 10/491,667

(22) PCT Filed: Oct. 4, 2002

(86) PCT No.: PCT/FR02/03386

§ 371 (c)(1),
(2), (4) Date: Apr. 5, 2004

(87) PCT Pub. No.: WO03/029081

PCT Pub. Date: Apr. 10, 2003

(65) Prior Publication Data

US 2004/0237478 A1 Dec. 2, 2004

(30) Foreign Application Priority Data

Oct. 4, 2001 (FR) ..... 01 12770

(51) Int. Cl.
*B65B 31/00* (2006.01)

(52) U.S. Cl. ..... 53/511; 53/510; 53/434

(58) Field of Classification Search ..... 53/434, 53/432, 433, 453, 510, 511
See application file for complete search history.

(56) References Cited

U.S. PATENT DOCUMENTS

| | | | | |
|---|---|---|---|---|
| 2,736,150 | A * | 2/1956 | Loew | 53/560 |
| 3,972,153 | A | 8/1976 | Kiellarson et al. | |
| 4,162,599 | A * | 7/1979 | Kyle | 53/77 |
| 4,223,513 | A * | 9/1980 | Mahaffy et al. | 53/432 |
| 4,296,588 | A * | 10/1981 | Vetter | 53/86 |
| 4,624,099 | A * | 11/1986 | Harder | 53/432 |
| 4,791,775 | A * | 12/1988 | Raque et al. | 53/510 |
| 5,103,618 | A * | 4/1992 | Garwood | 53/433 |
| 5,271,207 | A * | 12/1993 | Epstein et al. | 53/432 |
| 5,447,736 | A * | 9/1995 | Gorlich | 426/396 |
| 5,813,197 | A * | 9/1998 | Aguzzoli | 53/453 |
| 6,289,654 | B1 * | 9/2001 | Yamaguchi et al. | 53/434 |
| 6,748,726 | B1 * | 6/2004 | Rossi et al. | 53/510 |

FOREIGN PATENT DOCUMENTS

| | | |
|---|---|---|
| EP | 0 314 546 | 5/1989 |
| FR | 2 769 289 | 4/1999 |

* cited by examiner

*Primary Examiner*—Sameh H. Tawfik
(74) *Attorney, Agent, or Firm*—Young & Thompson

(57) ABSTRACT

A filling and sealing device includes an upper part forming a bell and a lower part forming a bowl, receiving a container to be sealed with a film in the chamber defined by the two parts. The upper part has a wall, on the side supplying the sealing film, inserting and filling elements emerging inside the chamber between the sealing film and the lower edge of the wall for inserting products into the chamber and for filling the container therein. Preferably, the upper part also includes above the inserting and filling elements, a slot for passing through the sealing film, closing and locking elements with controlled actuation for closing the slot and lock the film relative to the upper part, and elements for introducing and/or removing fluid (gas).

7 Claims, 4 Drawing Sheets

DEVICE FOR PACKAGING PRODUCTS UNDER CONTROLLED ATMOSPHERE

BACKGROUND OF THE INVENTION

The present invention relates to a filling and sealing device for a machine for packaging products under a controlled atmosphere, more particularly food products, which may be solid, rigid or in pieces, in containers such as trays, pots and similar packages, sealed with a film.

DESCRIPTION OF THE RELATED ART

The packaging of food and other products in such sealed packages is carried out on machines called "sealers" or "thermoformer-sealers", depending on whether the containers to be sealed are produced beforehand on another machine or are produced by thermoforming a thermoplastic sheet, for example, on the same machine as that on which the sealing is carried out. It is often necessary, especially when packaging food products, pharmaceutical products or other products that are perishable or pose problems, for the purpose of better preservation, protection and/or hygiene, to carry out the sealing under a vacuum or in a controlled atmosphere, an operation which involves removing air and/or injecting (or reinjecting) gas.

A known and commonly used solution consists in removing the air and/or injecting gas through holes made in the sides of the thermoforming film, along the drive systems. This solution does, admittedly, make it possible to establish a well-controlled atmosphere in the packages, but entails a not insignificant loss of thermoforming film, the latter having to be of a substantially greater width than the containers to be sealed, but does not allow the trays to be filled with products in the sealing station.

Other solutions proposed up until now for this purpose (see, for example, documents U.S. Pat. No. 4,162,599, U.S. Pat. No. 4,624,099, U.S. Pat. No. 5,271,207, WO 96/09210) are complicated and expensive and yet are not entirely satisfactory. In particular, they do not make it possible to produce, at the sealing station, satisfactory or reliable sealing of the chamber created around the container to be sealed, especially at the air-removal and/or purge-gas injection system, between the sealing film and the container to be sealed, and especially do not allow trays to be filled directly in the sealing station.

In order to overcome the disadvantages concerning the insufficient sealing at the sealing station, document WO 99/17990 proposes a sealing device for a sealed-container packaging machine, which device, while being of particularly simple and reliable structure, ensures perfect sealing of the chamber in which the welding of the sealing film to the container takes place, thus making it possible to create, in the sealed container, a better controlled atmosphere than was possible until now and moreover allowing fluid products (for example liquid, pasty or powdered products) to be introduced into the container inside the welding or sealing station, before completely sealing the container. This sealing device, intended for a machine for packaging products under a controlled atmosphere in containers such as trays, pots and similar containers sealed with a film, comprises an upper part forming a bell and provided with a welding head, and a lower part forming a pan. The lower part receives at least one container to be sealed and interacts with the upper part so as to define, around the container to be sealed, a chamber in which continuous sealing film supplied beforehand over the container is welded to the container by the welding head of the upper part. The upper part comprises, in one lateral wall, on the side on which the sealing film is supplied, a through slot for the sealing film, controlled-actuation closing and locking means for closing off said slot and locking the film with respect to the upper part, means for introducing and/or removing fluid (gas, air), and, where appropriate, filling means comprising spouts or orifices for introducing fluid products (liquid, semi-liquid, pasty or powdered products) that emerge inside the chamber between said slot and the lower edge of said wall.

No provision in made in document WO 99/17990 for filling the containers with products other than fluids at the sealing station.

SUMMARY OF THE INVENTION

The subject of the present invention is a device for packaging products in a controlled atmosphere that makes it possible, more particularly, to fill containers, inside the sealing station, with products that may even have a nonfluid consistency (rigid products, solid products, products in pieces, etc.), it being possible, and preferable, for these products to have been placed under a modified or controlled atmosphere beforehand.

More particularly, the subject of the invention is a device for filling and sealing such packaging containers, having all the advantages and characteristics of the device according to document WO 99/17990, and therefore being complementary to this device but having a higher level of performance and possessing a structure that is better suited to an industrial packaging process and especially having the advantage of allowing containers to be filled directly inside the sealing station, by virtue of the possibility of introducing, into the chamber surrounding the container to be filled and sealed, all types of products, of any kind, form, appearance and consistency but more particularly rigid products, solid products or products in pieces, if necessary placed under a modified or controlled atmosphere beforehand, it being possible for these products to be, in particular, food products such as loins of pork, poultry, fish such as processed or whole salmon, pates, vegetables, etc.

The advantages of these inserting and filling means are many, since they make it possible, by virtue of introducing any products into the containers directly in the sealing station, to improve and ensure protection of the food products and to considerably increase their shelf-life and hygiene levels, since it is from now on possible for some of these products to be sent, transferred or conveyed directly from the manufacturing room into the sealing station of a packaging machine, or by way of metering equipment, thereby making it possible, by eliminating all intermediate, external and environmental sources of contamination, to avoid clean rooms, laminar flow systems, etc., in the case of certain fragile products such as yogurts or certain delicatessen products, meats, fish, and vegetables that may or may not have been modified, etc.

BRIEF DESCRIPTION OF THE DRAWINGS

With reference to the appended schematic drawings, a more detailed description will be given hereinbelow of an illustrative and nonlimiting embodiment of a filling and sealing device according to the invention; in the drawings.

DESCRIPTION OF THE PREFERRED EMBODIMENTS

Figure 1:
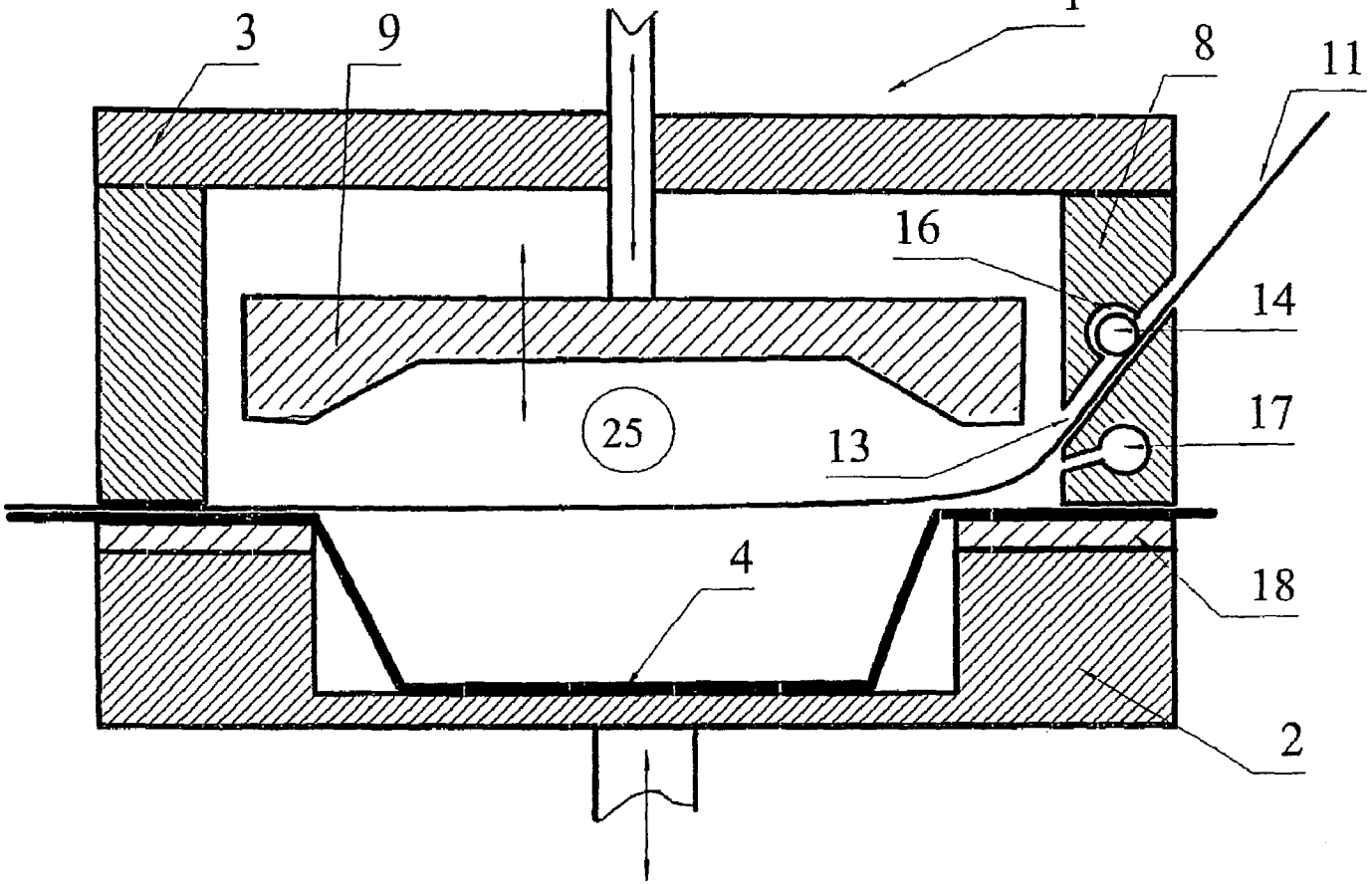
FIG. 1 PRIOR ART
FIGS. 1 and 2 are schematic cross sections through a sealing device according to document WO 99/17990.
Figure 2:
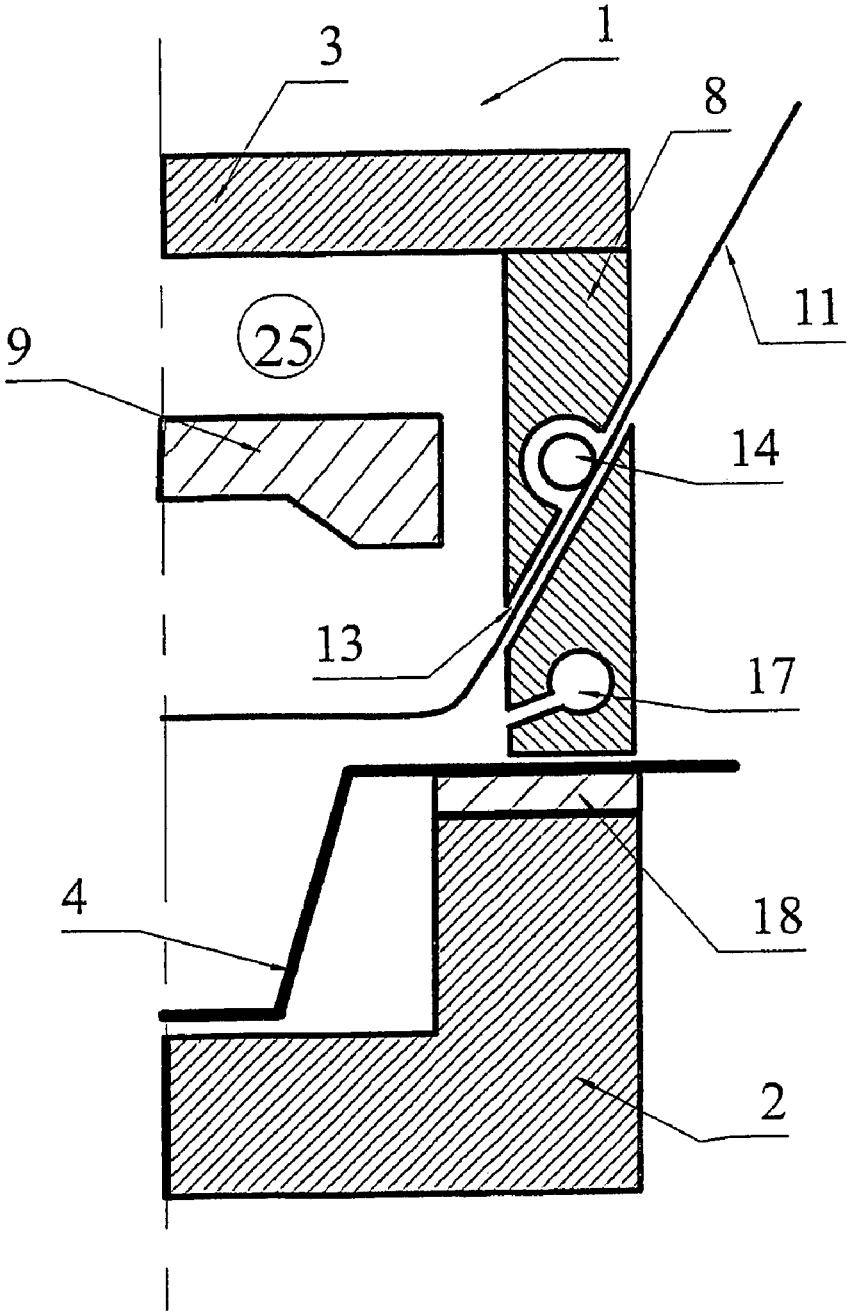
FIG. 2 PRIOR ART

According to FIGS. 1 and 2, the sealing device (1) of a machine for packaging products, in particular food products, in thermoformed trays intended to be sealed with a film (11), this device here forming part of a thermoformer-sealer, comprises a lower part (2) in the form of a pan, intended to receive a tray (4) and fitted with a seal (18) on its upper edge, and with a stationary upper part (3) in the form of a bell, comprising a frame (8) secured to a support plate and surrounding a movable welding head (9) that serves to weld the film (11) to the rim of the tray (4).

The frame (8) of the upper part (3) of the welding device has a slot (13) running through its wall situated on the side on which the sealing film (11) is supplied, through which slot the film. (11) passes. Associated with the slot (13) is a controlled-actuation closing and locking means (14) consisting, for example, of an inflatable rubber hose mounted in a hole (16) that emerges into the slot (13) such that, when inflated, the hose (14) locks the sealing film (11) in the slot (13) and closes off this slot in a completely sealed manner.

The frame (8) moreover comprises, in the same wall, between the slot (13) and the lower edge of this wall, one or more orifices or nozzles (17), for example for removing or injecting gas, emerging inside of the chamber (25) bounded between the two parts (1) and (2) or of the frame (8).

Figure 3:
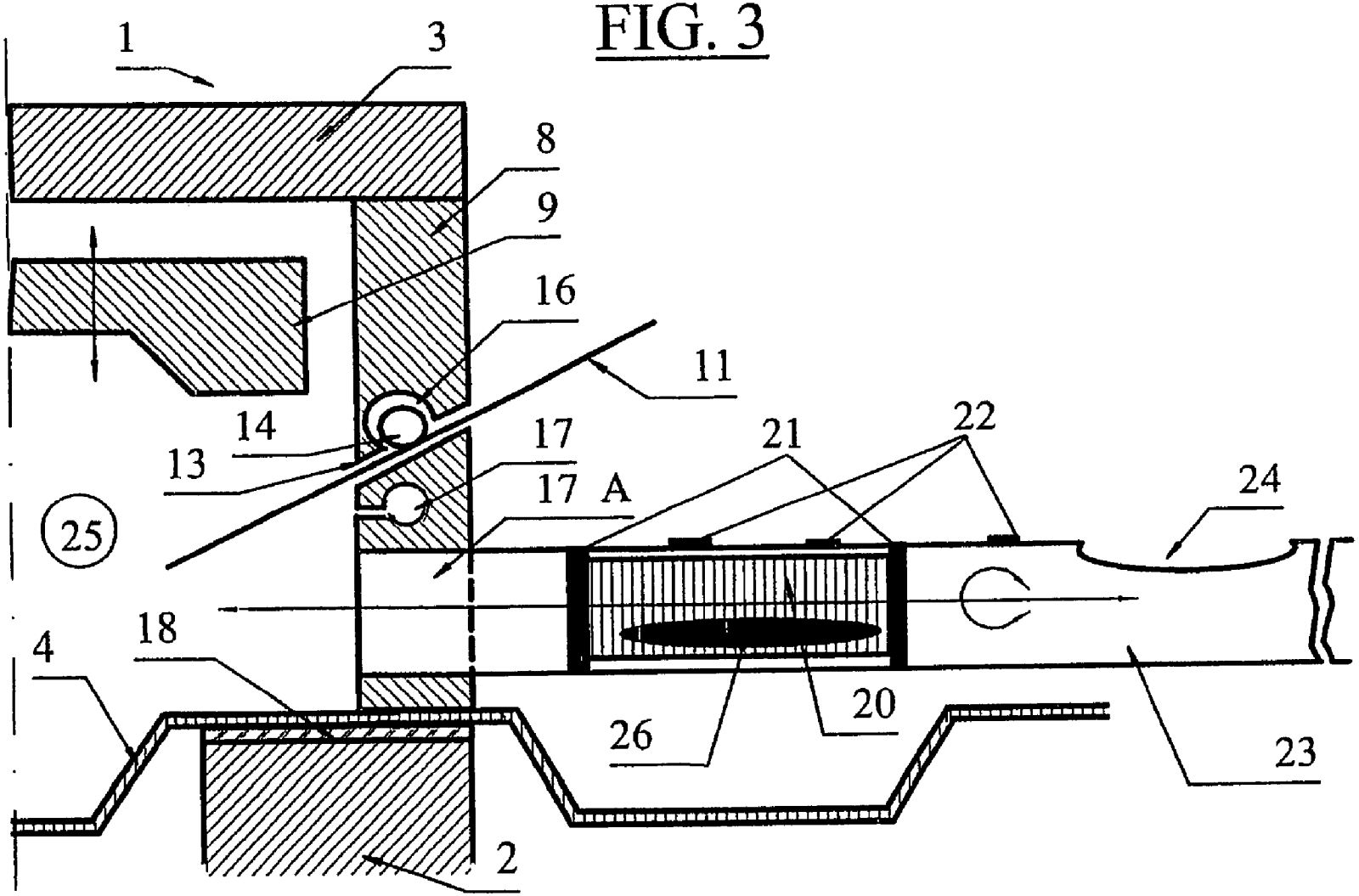
FIGS. 3 and 4 are schematic cross sections through two embodiments of a device according to the present invention, comprising, in addition to the means already illustrated in FIGS. 1 and 2, means for filling the container with products, for example rigid products, directly into the chamber surrounding the container at the sealing station.
Figure 4:
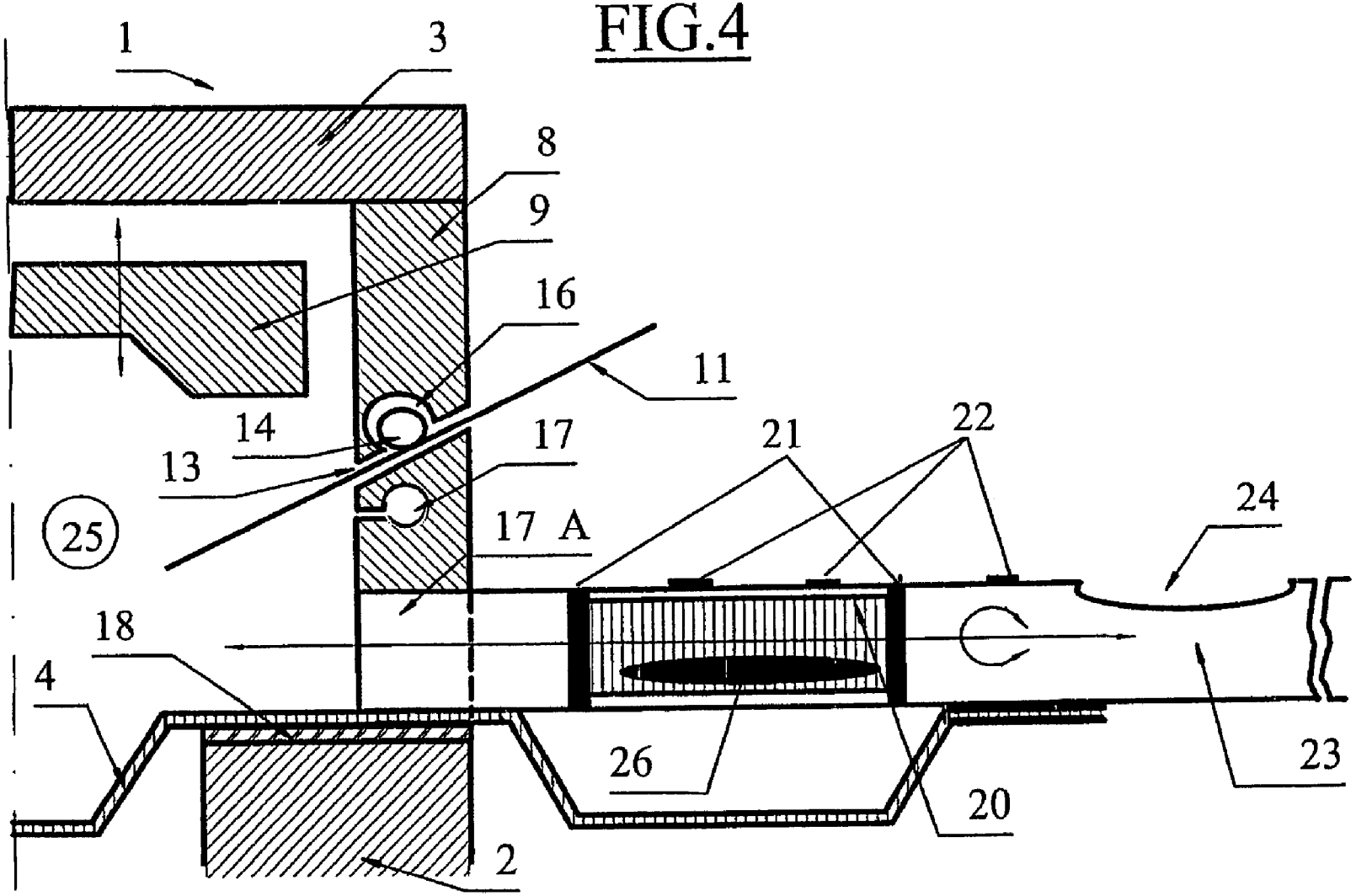

The device according to the present invention, and as illustrated by FIGS. 3 and 4, which assumes all the characteristics of the device according to FIGS. 1 and 2, comprises in addition to the orifices or nozzles (17), which, by virtue of their small size (cross section), are able to serve only for removing and/or injecting gas and/or introducing more or less fluid products, at least one orifice or nozzle (17A) of larger size (cross section) designed to allow the passage of all products and particularly of more substantial products, which may be solid, rigid or in pieces.

These larger orifices (17A), which may have varied cross sections and shapes according to the products that have to be able to be introduced through them into the tray (4) enclosed in the chamber (25) and may consist of all sorts of different materials, such as, inter alia, aluminum, stainless steel, plastic, etc., depending on the applications and the products to be packaged, may advantageously be supplemented, to allow the best transfer and care of the products toward the sealing station (in the chamber 25), by manual or preferably automated inserting and filling means of the airlock type, in order to introduce the products (26) into the chamber (25) and deposit them in the tray (4) without adversely affecting the controlled atmosphere prevailing in the chamber (25). These inserting and filling means may in particular comprise mobile transfer means (20), such as carriages in the form of shuttles, mounted for example such that they may or may not be able to tilt or pivot and so that they can move back and forth with an axial translational movement, under the action of cylinder activators or similar drive means, within guides (23), for example tubular guides, which may be provided with openings (24) for loading products into the shuttles (20) from outside the packaging machine. It should be noted that in FIGS. 3 and 4 the guides (23) for the shuttles (20) may comprise, in one or more locations, means (22) for setting a modified or controlled atmosphere that are independent and/or individual and/or centralized, and the shuttles (20) in which the products (26) are advantageously supported by means such as gratings may comprise seals (21) that provide perfect sealing of the shuttles within the guides, this making it possible for the products (26) to be introduced under a perfectly controlled atmosphere, through the orifices or nozzles (17A) into the chamber (25) and into the trays (4), without disturbing the controlled atmosphere already created in the chamber and thus in the trays by virtue of the orifices or nozzles (17) for fluids.

The embodiment according to FIG. 3 shows an orifice (17A) made in the frame (8) on the same side as the slot (13) through which the film (11) passes, at a distance above the lower edge of the frame, thus between said lower edge and the slot (13) through which the film (11) passes, and more precisely between said lower edge and the orifice or nozzle (17) for fluid.

In the embodiment according to FIG. 4, the orifice (17A) for introducing the product to be packaged into the tray (4) is, by contrast, in the form of a cutout that is made in the lower edge of the frame (8). This orifice (17A) is therefore situated directly on the connecting portion between two successive trays (4) when the sealing device (1) is closed around a tray (4) by the vertically movable lower part (2) being raised against the stationary upper part (3).

It should be pointed out that in the embodiments according to the invention, illustrated by FIGS. 3 and 4, the sealing device (1), or more precisely the frame (8) of the upper part (2), is higher than in the case of the embodiment according to FIGS. 1 and 2, owing to the presence of the orifice (17A) below the slot (13) through which the film (11) passes, this slot (13) thus also being situated higher (with respect to the tray (4) to be sealed with the film (11)). For this reason, it may thus be wise, or even necessary, in certain instances to provide the sealing device (1) with means allowing an excess length of film (11) to be advanced toward the inside of the chamber (25) through the slot (13), this excess length of film being taken up when the welding head (9) drops onto the tray (4) or similar container. This excess length of film may be advanced, for example, by mechanical, electrical, pneumatic or motorized means, by pressure, suction, blowing air, etc.

The invention claimed is:

1. A device for filling and sealing packages for a machine for packaging products under a controlled atmosphere in containers to be sealed with a film; comprising:

a stationary upper part forming a bell and provided with a vertically movable welding head;

a vertically movable lower part forming a pan, the lower part being adapted for receiving at least one container to be sealed and interacting with the upper part so as to define a chamber around the container to be sealed a chamber;

an opening in the chamber, located above the container received inside the chamber for introducing in said chamber a continuous sealing film, said film being thereafter welded to the container by the welding head of the upper part;

means for closing off said opening and locking the sealing film;

means for establishing a controlled atmosphere inside the chamber;

first inserting and filling means emerging inside the chamber below said sealing film for introducing fluid products into said chamber for filling the container received inside the chamber;

second inserting and, filling means emerging inside the chamber below the first inserting and filling means and having a larger cross section than a cross section of said first inserting and filling means for introducing non-fluid products to be packaged into said chamber and for filling the container received inside in said chamber, before welding of the sealing film to the container;

a guide means mounted into said second inserting and filling means;

means for setting a controlled atmosphere within said guide means; and mobile transfer means mounted for reciprocal translation within said guide means and provided with supporting means for said non-fluid products that allows to introduce said products into the chamber without disturbing the controlled atmosphere of the chamber.

2. The device as claimed in claim 1, further comprising means for advancing the sealing film in order to supply and accumulate an excess length of sealing film in the chamber and to take up the excess length when the welding head drops onto the container to be sealed.

3. The device as claimed in claim 1, wherein the opening for supplying the sealing film into the chamber is a through slot made in the upper part at a distance above the lower edge of the upper part.

4. The device as claimed in claim 3, further comprising actuation-controlled closing and locking means for closing off said slot and locking the film with respect to the upper part.

5. The device as claimed in claim 1, further comprising means for introducing or removing fluid that emerges into the chamber between the opening for supplying the sealing film and the inserting and filling means.

6. The device as claimed in claim 1, wherein the mobile transfer means is able to pivot or tilt.

7. The device as claimed in claim 1, wherein said guide means comprises at least one opening for loading the products into said mobile transfer means.

* * * * *